US007108520B1

(12) United States Patent
Delaney et al.

(10) Patent No.: US 7,108,520 B1
(45) Date of Patent: Sep. 19, 2006

(54) BOARD MOUNTED ELECTRICAL CONNECTOR

(75) Inventors: Kevin Delaney, Ennis (IE); Colm Conlon, Ennis (IE); Colm Fennell, Ennis (IE); George Hesse, Co Clare (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/123,653

(22) Filed: May 6, 2005

(51) Int. Cl.
*H01R 12/00* (2006.01)

(52) U.S. Cl. ..... 439/79; 439/660; 439/80

(58) Field of Classification Search ..... 439/79, 439/80, 74, 328, 660
See application file for complete search history.

(56) References Cited

U.S. PATENT DOCUMENTS

| | | | | |
|---|---|---|---|---|
| 4,780,095 | A | 10/1988 | Classon et al. | |
| 5,078,611 | A | 1/1992 | Tanigawa et al. | |
| 5,221,210 | A | 6/1993 | Bormuth et al. | |
| 5,244,420 | A | 9/1993 | Lopata | |
| 5,547,384 | A * | 8/1996 | Benjamin | 439/79 |
| 5,727,957 | A | 3/1998 | Hashimoto et al. | |
| 5,876,222 | A * | 3/1999 | Gardner et al. | 439/79 |
| 5,951,335 | A | 9/1999 | Kurotori et al. | |
| 5,971,809 | A * | 10/1999 | Ho | 439/660 |
| 6,302,710 | B1 * | 10/2001 | Wang et al. | 439/79 |
| 6,358,100 | B1 | 3/2002 | Watanabe et al. | |
| 6,371,771 | B1 * | 4/2002 | Fan | 439/79 |
| 6,454,610 | B1 * | 9/2002 | Yu | 439/660 |
| 6,464,521 | B1 | 10/2002 | Kurotori et al. | |
| 6,508,676 | B1 * | 1/2003 | Xu | 439/660 |
| 6,666,702 | B1 | 12/2003 | Pickles | |
| 6,743,060 | B1 * | 6/2004 | Wu | 439/741 |
| 6,776,664 | B1 * | 8/2004 | Huang | 439/660 |
| 2003/0224632 | A1 * | 12/2003 | Regnier et al. | 439/79 |

* cited by examiner

*Primary Examiner*—Tulsidas C. Patel
*Assistant Examiner*—Vladimir Imas
(74) *Attorney, Agent, or Firm*—Stephen Z. Weiss

(57) ABSTRACT

A circuit board mounted electrical connector includes a dielectric housing having a top face, a bottom board-mounting face and a front mating portion extending generally parallel to the circuit board. A set of first terminals are mounted in the housing through the top face thereof. The first terminals have tail portions for connection to appropriate circuit traces on the circuit board. The first terminals have contact portions on a top side of the mating portion of the housing for engaging appropriate contacts of a complementary mating connecting device. A set of second terminals are mounted on the housing through the bottom board-mounting face thereof. The second terminals have tail portions for connection to appropriate circuit traces on the circuit board. The second terminals have contact portions on a bottom side of the mating portion of the housing for engaging appropriate contacts on the mating connecting device.

12 Claims, 5 Drawing Sheets

FIG. 1
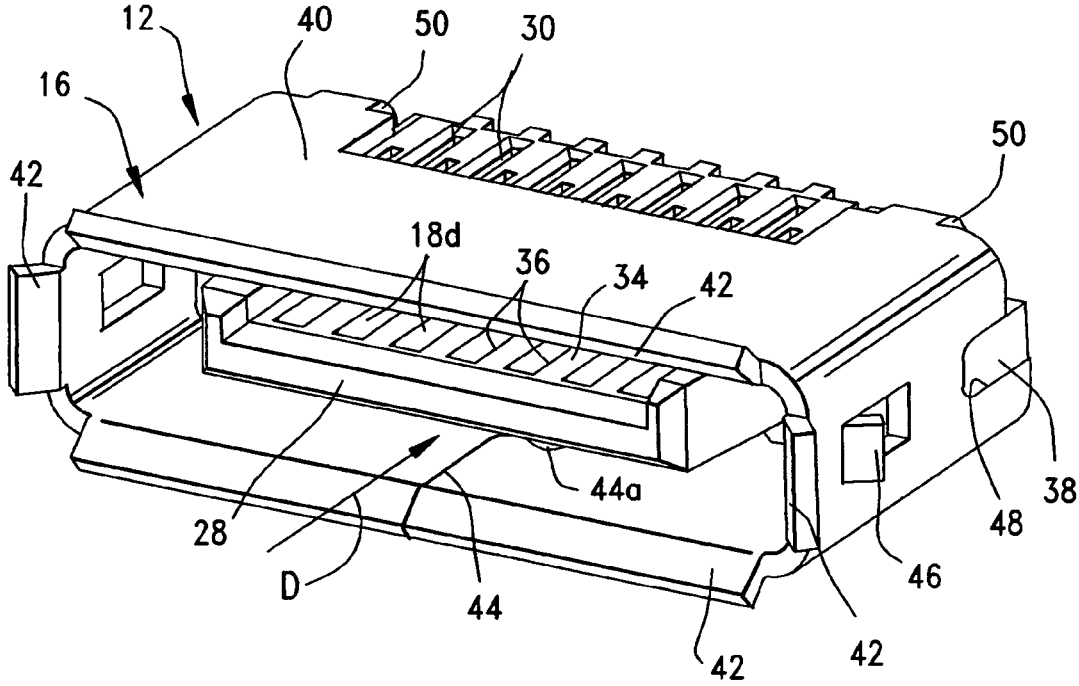
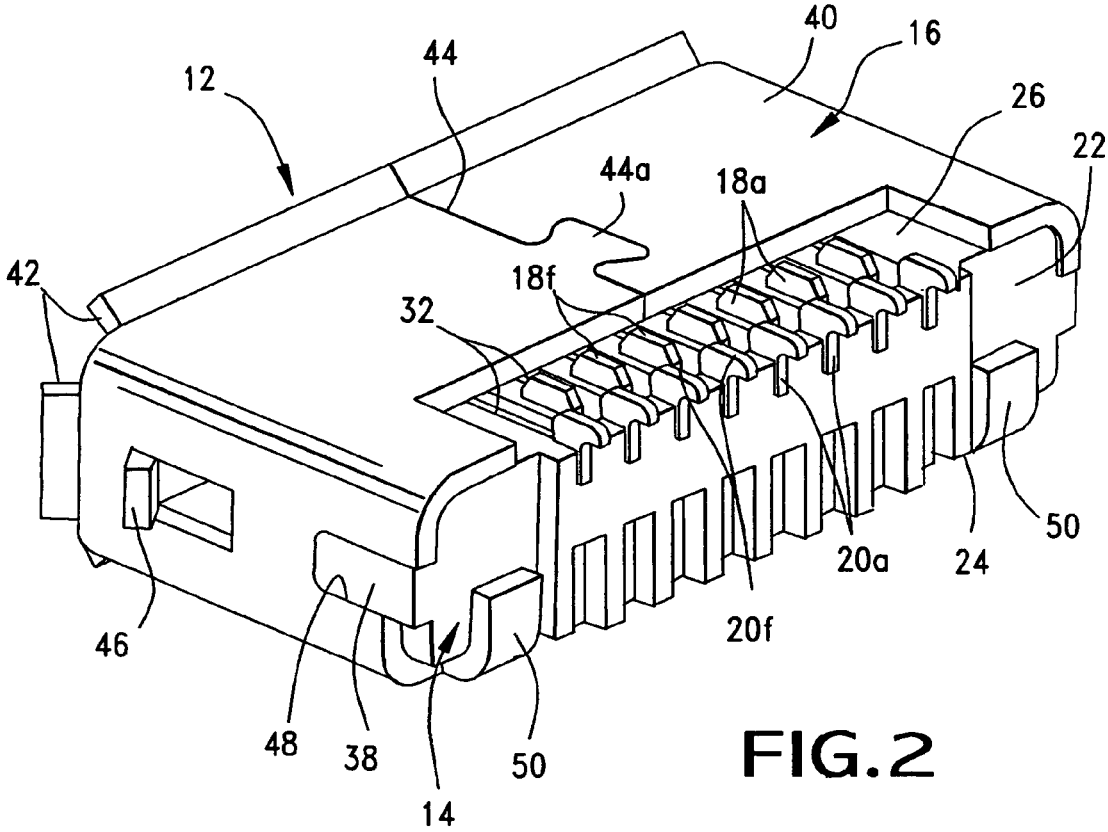
FIG. 2

FIG.9
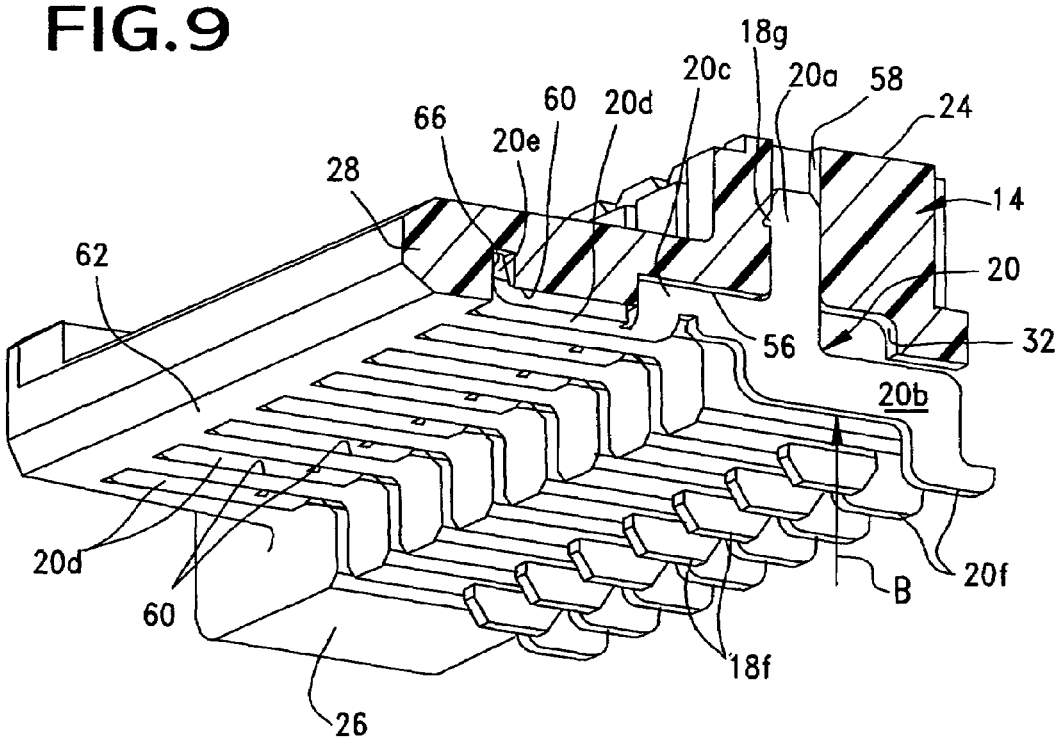
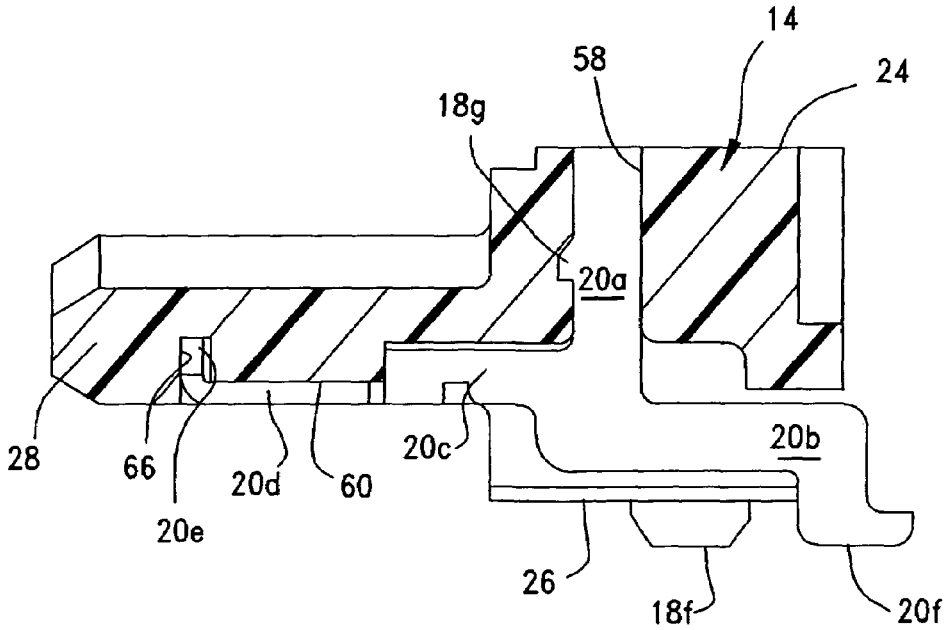
FIG.10

BOARD MOUNTED ELECTRICAL CONNECTOR

FIELD OF THE INVENTION

This invention generally relates to the art of electrical connectors and, particularly, to an electrical connector for mounting on a printed circuit board.

BACKGROUND OF THE INVENTION

Generally, an electrical connector includes some form of dielectric or insulative housing which mounts one or more conductive terminals. The housing is conFIG.d for mating with a complementary mating connector or other connecting device which, itself, has one or more conductive terminals. A connector assembly typically includes a pair of mating connectors, such as plug and receptacle connectors sometimes called male and female connectors.

Various types of electrical connectors are designed for mounting on a printed circuit board. The connectors have terminals which include contact portions for engaging the terminals of a complementary mating connector. The terminals of a board-mounted connector have terminating ends for connection to appropriate circuit traces on the circuit board, such as solder tails for solder connection to the circuit traces on a top surface of the circuit board and/or in holes in the board. Some board-mounted connectors have mating portions extending generally parallel to the circuit board for mating with a complementary connector in a direction parallel to the board. Problems often are encountered in mounting terminals in board-mounted connectors and maintaining the tail portions of the terminals generally planar relative to the flat circuit board. The present invention is directed to solving these problems and satisfying a need for providing a very simple board-mounted electrical connector which is easy, simple and inexpensive to manufacture and assemble.

SUMMARY OF THE INVENTION

An object, therefore, of the invention is to provide a new and improved electrical connector for mounting on a circuit board.

In the exemplary embodiment of the invention, the board-mounted electrical connector includes a dielectric housing having a top face, a bottom board-mounting face and a front mating portion extending generally parallel to the circuit board. A set of first terminals are mounted in the housing through the top face thereof. The first terminals have tail portions for connection to appropriate circuit traces on the circuit board. The first terminals have contact portions on a top side of the mating portion of the housing for engaging appropriate contacts of a complementary mating connecting device. A set of second terminals are mounted on the housing through the bottom board-mounting face thereof. The second terminals have tail portions for connection to appropriate circuit traces on the circuit board. The second terminals have contact portions on a bottom side of the mating portion of the housing for engaging appropriate contacts on the mating connecting device.

According to one aspect of the invention, the top and bottom sides of the mating portion of the housing have positioning channels for receiving the respective contact portions of the terminals. As disclosed herein, the contact portions are generally flat and generally coplanar at the top and bottom sides of the mating portion of the housing which, itself, is flat with generally planar top and bottom sides parallel to the circuit board.

According to other aspects of the invention, the contact portions of the terminals have bent distal ends positioned in recesses in the mating portion of the housing to prevent the distal ends from stubbing on the contacts of the mating connecting device. The tail portions of the first and second terminals have coplanar surfaces for soldering to circuit traces on a mounting surface of the circuit board.

According to further aspects of the invention, the first terminals have upwardly projecting pusher tabs to facilitate inserting the first terminals into the housing from the top face thereof, until the tail portions of the first terminals are exposed at the bottom board-mounting face of the housing. The housing has an open rear end which allows for visual inspection of the connections between at least some of the terminals and the circuit traces on the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a top, front perspective view showing the mating end of the board-mounted electrical connector of the invention;

FIG. 2 is a bottom, rear perspective view of the connector;

FIG. 9 is a sectioned perspective view showing one of the bottom terminals mounted in the housing; and FIG. 10 is a side section of the depiction in FIG. 9.

DETAILED DESCRIPTION OF THE PREFERRED EMBODIMENT

Figure 4:
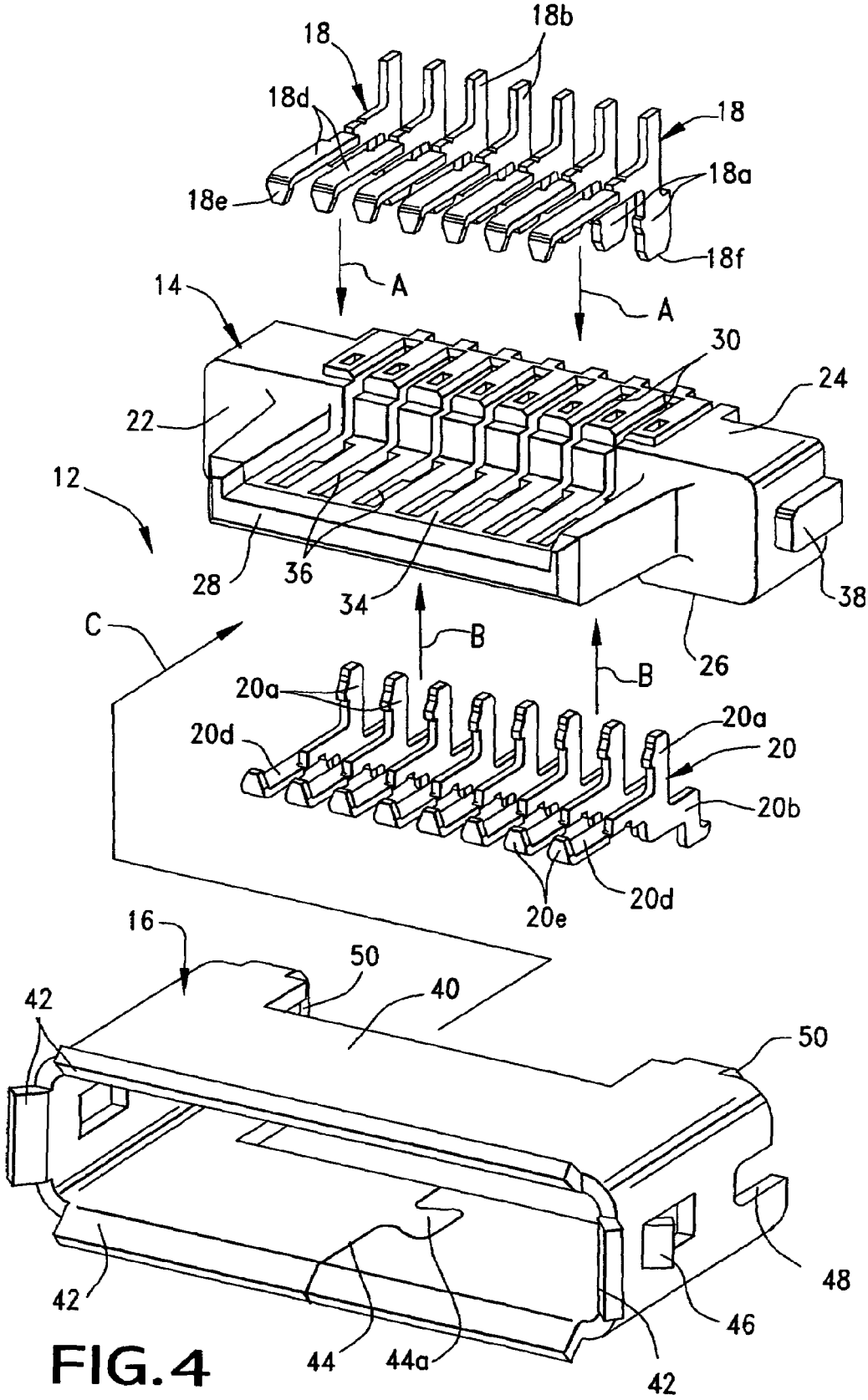
FIG. 4 is an exploded perspective view of the connector.

Referring to the drawings in greater detail, and first to FIGS. 1–4, the invention is embodied in an electrical connector, generally designated 12, for mounting on a circuit board (not shown). As is known in the art, the circuit board is flat and, typically, includes a top surface having circuit traces thereon. Connector 12 is extremely simple and, basically, includes four components, namely: a dielectric or insulative housing, generally designated 14, surrounded by a metal shield, generally designated 16, along with a set of first or top terminals, generally designated 18 (FIG. 4), and a set of second or bottom terminals, generally designated 20. The top and bottom terminals 18 and 20, respectively, are mounted through the top and bottom of housing 14 as will be seen in greater detail hereinafter. Top terminals 18 are inserted into the housing in the direction of arrow "A" (FIG. 4). Bottom terminals 20 are inserted into the housing in the direction of arrows "B". Metal shield 16 is assembled to the housing in the direction of arrow "C".

Dielectric housing 14 is a one-piece structure unitarily molded of dielectric material such as plastic or the like. The housing includes a generally rectangular main body portion 22 which is elongated in a direction transverse to arrow "C" which is the mating direction of the connector. The housing has a top face 24, a bottom board-mounting face 26 and a front mating portion 28 extending forwardly in a direction generally parallel to the circuit board. A plurality of vertical slots 30 (FIGS. 3 and 4) are formed in the body portion through top face 24 for receiving top terminals 18. A plurality of vertical slots 32 (FIG. 2) are formed in the housing through bottom face 26 for receiving bottom terminals 22. A flat top side 34 of mating portion 28 of the housing has a plurality of elongated channels 36 for receiving contact portions of top terminals 18 as will be seen hereinafter. Similarly, the bottom side of the mating portion has channels (not visible in FIGS. 1–4) for receiving contact portions of the bottom terminals. Finally, a shield positioning boss 38 projects outwardly from each opposite end of body portion 22 of the housing.

Metal shield 16 is stamped and formed of sheet metal material to form an elongated, generally rectangular shroud 40 for positioning about the generally elongated rectangular body portion 22 of housing 14 and substantially surrounding the housing including mating portion 28. It can be seen in FIG. 1 that shroud 40 is spaced from mating portion 28 of the housing about all sides thereof for receiving a female mating portion of the complementary mating connector inserted into the shroud in the direction of arrow "D" (FIG. 1). To that end, the front edges of the shroud are flared outwardly, as at 42, to facilitate inserting the mating portion of the mating connector into connector 12. Metal shield 16 is a one piece structure folded into its elongated rectangular configuration and joined at a seam 44 having a dove-tailed securing section 44*a*. Opposite ends of the shield are provided with outwardly flared latches 46 for engaging complementary latches on the mating connector. Rearwardly opening positioning notches 48 are stamped into opposite ends of shield 16 for receiving the positioning bosses 38 at opposite ends of housing 14. When the shield is fully assembled to the housing, positioning bosses 38 of the housing seat securely within positioning notches 48 of the metal shield. A pair of fixing tabs 50 then are bent as shown in FIG. 2 against the rear of housing 14 to securely hold the shield and housing in assembled condition as shown in FIGS. 1 and 2.

Figures 3, 5:
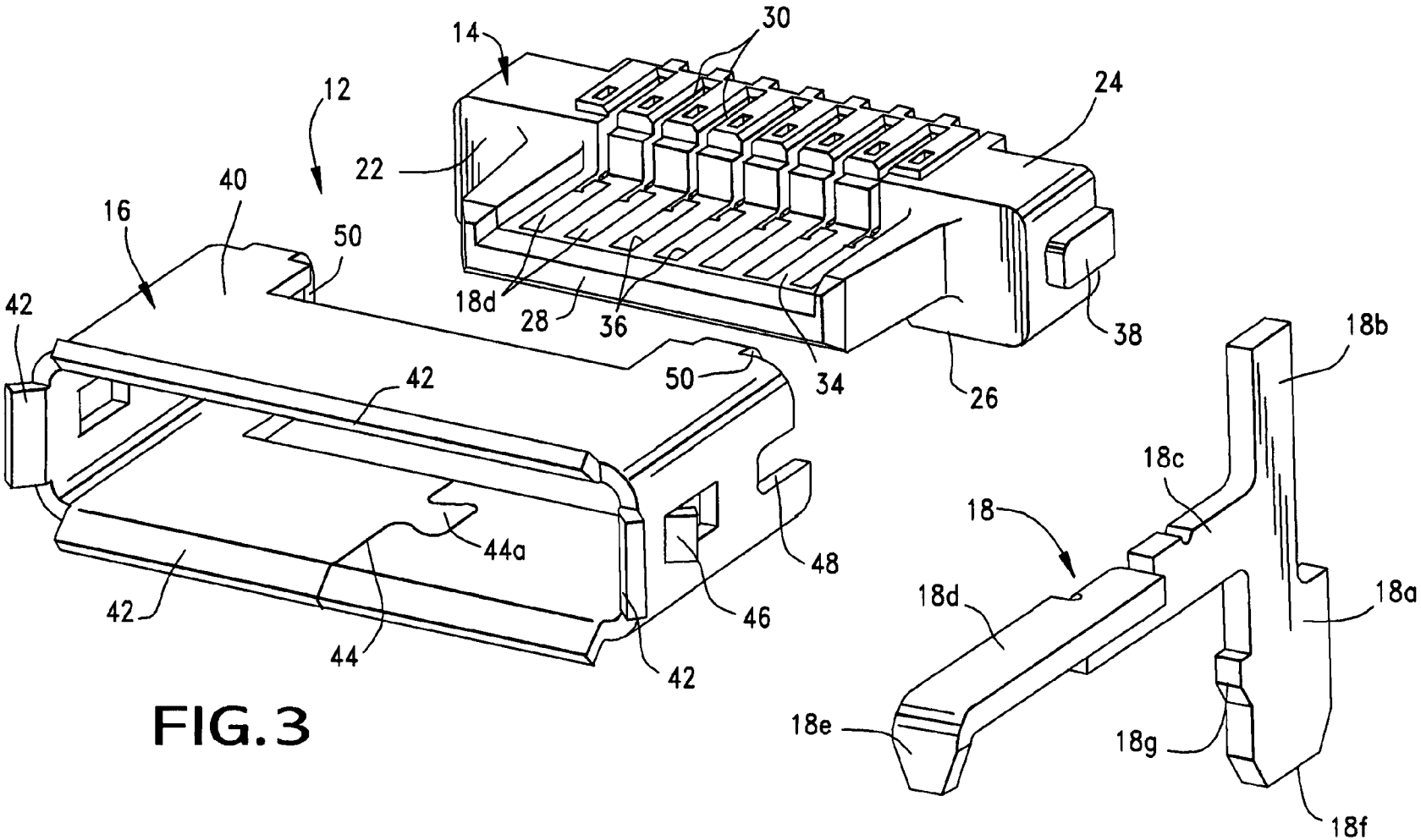
FIG. 3 is a view similar to that of FIG. 1, with the metal shield removed from the connector housing.
FIG. 5 is a perspective view of one of the first or top terminals.

Referring to FIG. 5, each top terminal 18 includes a downwardly extending fixing portion or tail 18*a*, an upwardly extending pusher portion or tab 18*b* and a forwardly extending arm portion 18*c* which terminates in a generally flat contact portion 18*d*. A distal end 18*e* of contact portion 18*d* is bent downwardly. Contact portion 18*d*, itself, is flat and is bent at a right-angle to arm portion 18*c*. Tail 18*a* has a flat bottom surface 18*f* for solder connection, as by soldering, to an appropriate circuit trace on the circuit board. The tail or fixing portion 18*a* has a fixing tooth 18*g* stamped at one side edge thereof for skiving into the plastic material of housing 14 to fix the terminal in the housing as will be seen hereinafter.

Figure 6:
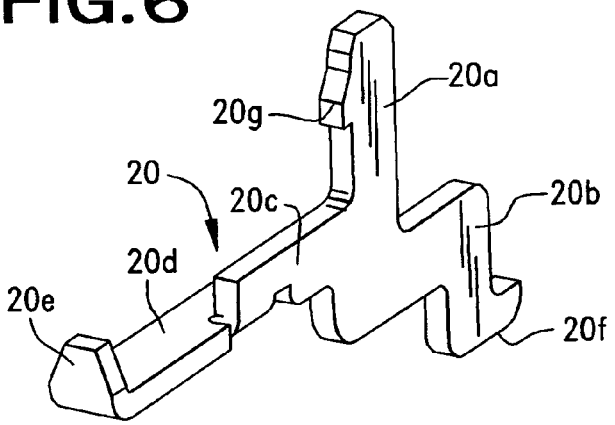
FIG. 6 is a perspective view of one of the second, bottom terminals.

Referring to FIG. 6, each bottom terminal 20 has an upwardly extending fixing portion 20*a*, a downwardly extending L-shaped tail portion 20*b* and a forwardly extending arm portion 20*c* which terminates in a generally flat contact portion 20*d*. A distal end 20*e* of the contact portion is bent upwardly. Contact portion 20*d*, itself, is flat and is bent at a right-angle to arm portion 20*c*. Tail 20*b* has a flat bottom surface 20*f* for connection, as by soldering, to an appropriate circuit trace on the circuit board. A fixing tooth 20*g* is stamped out of one edge of fixing portion 20*a* for skiving into the plastic material of the housing to secure the bottom terminal within the housing as will be seen hereinafter.

Figure 7:
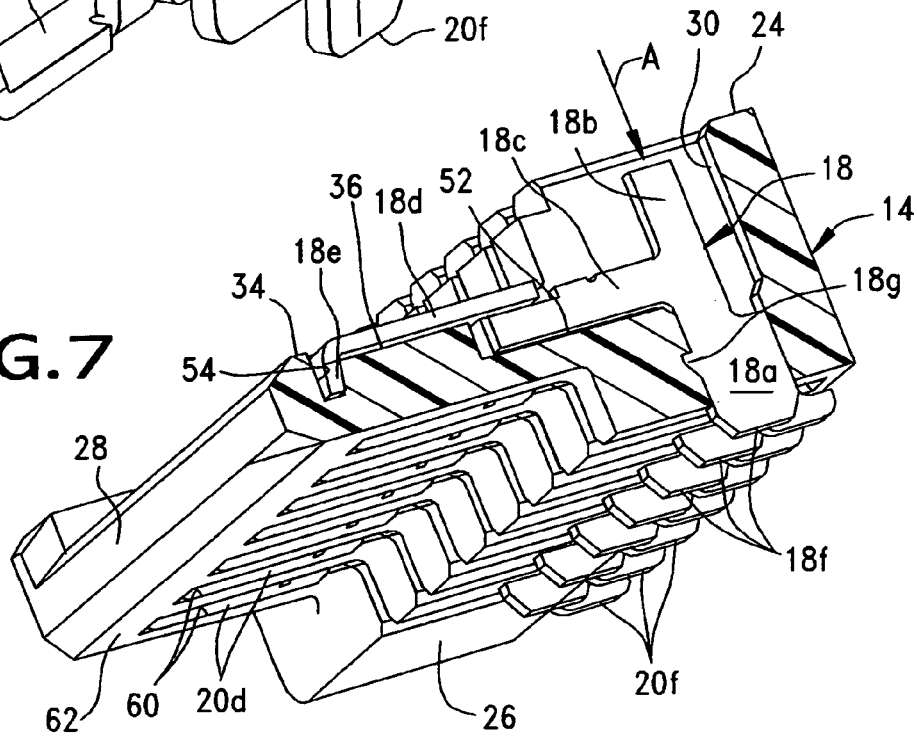
FIG. 7 is a sectioned perspective view showing one of the top terminals mounted in the housing.
Figure 8:
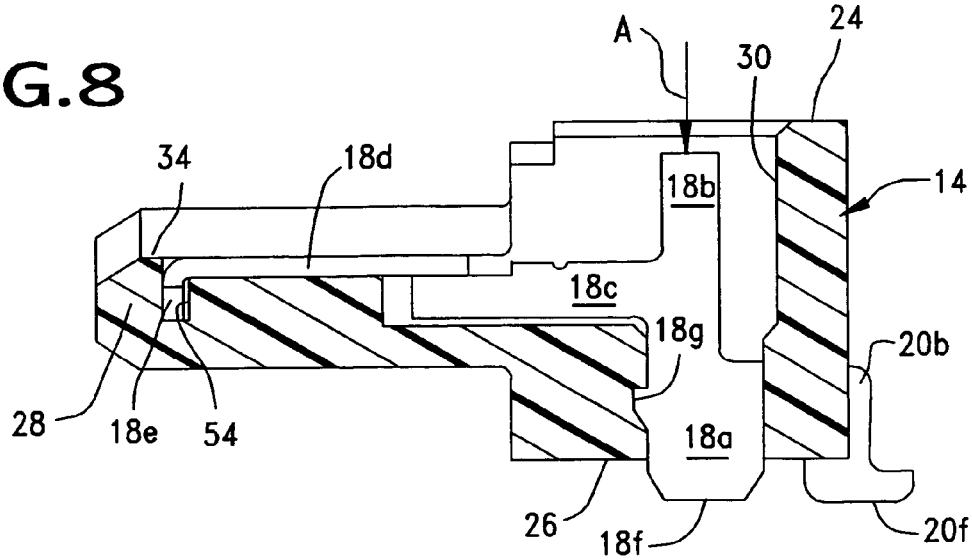
FIG. 8 is a side section of the depiction in FIG. 7.

FIGS. 7 and 8 show how one of the top terminals 18 is mounted within one of the vertical grooves 30 in dielectric housing 14. As stated above, the terminals are inserted into the housing in the direction of arrow "A". The terminals are inserted until arm portions 18*c* abut against interior abutment surfaces 52 within slots 30. Fixing teeth 18*g* will skive into the plastic material of the housing to securely fix the terminals in the housing within their respective grooves 30. When the top terminals are fully inserted, flat contact portions 18*d* are positioned within positioning channels 36 in top side 34 of mating portion 28 of the housing. The top surfaces of flat contact portions 18*d* are generally flush with the top surface of top side 34 of the mating portion. The downwardly bent distal ends 18*e* of the top terminals are inserted into a plurality of positioning recesses 54 so that the distal ends of the contact portions of the terminals do not "stub" on the contacts or terminals of the mating connector. Finally, tails 18*a* of the top terminals project downwardly below the bottom board-mounting face 26 of the housing so that the flat bottom surfaces 18*f* of the terminals are exposed for engaging their respective circuit traces on the circuit board.

FIGS. 9 and 10 show how one of the bottom terminals 20 is inserted in the direction of arrow "B" into its respective slot 32 in housing 14. The bottom terminals are inserted until arm portions 20*c* of the terminals abut against interior abutment surfaces 56 formed within slots 32. The fixing portion 20*a* of each bottom terminal 20 is inserted into a hole 58 formed at the bottom of the respective slot 32. When the terminals are fully inserted, fixing teeth 18*g* skive into the plastic material of the housing and secure the terminals therewithin while preventing the terminals from backing out of grooves 32. When the terminals are fully inserted, the flat contact portions 20*d* of the terminals are positioned within a plurality of positioning channels 60 formed in a flat bottom side 62 of mating portion 28. The flat bottom surfaces of contact portions 20*d* are generally flush with flat bottom side 62 of the mating portion. The upwardly bent distal ends 20*e* of the contact portions are inserted into recesses 66 formed in mating portion 28 to prevent the distal ends from stubbing on the contacts or terminals of the mating connector. The vertical legs of the L-shaped tail portions 20*b* of the bottom terminals project downwardly below the bottom board-mounting face 26 of the housing so that the flat bottom surfaces 20*f* of the tail portions are exposed for connection, as by soldering, to appropriate circuit traces on the circuit board.

It can be seen in FIGS. 8 and 10 that both the flat bottom surfaces 18*f* of the top terminals are the flat bottom surfaces 20*f* of the bottom terminals are coplanar for connection to the circuit traces on the flat or planar top surface of the circuit board. When connector 12 is mated with the complementary mating connector or other connecting device, the top and bottom surfaces of contact portions 18*d* and 20*d*, respectively, of the top and bottom terminals 18 and 20, respectively, are exposed at the top and bottom sides 34 and 62, respectively, of mating portion 28 for engaging the contact portions of the terminals of the mating connector.

With the above description of the insertion of the top and bottom terminals 18 and 20, respectively, into housing 14 of connector 12, it can be understood that the manufacture and assembly of connector 12 is extremely simple. In addition, the coplanarity of flat bottom surfaces 18*f* and 20*f* of the terminals are easy to be maintained with precision. In actual practice, top terminals 18 first are stitched into slots 30 in housing 14 to preloaded but not fully inserted positions. A bottom assembly plate then is used to force bottom terminals 20 into their fully inserted positions within slots 32. The top terminals then are fully inserted by pushing on pusher tabs 18*b* to force the terminals to their fully inserted positions against the bottom assembly plate which was used to insert the bottom terminals, positively ensuring coplanarity of the flat bottom surfaces 18*f* and 20*f* of the terminals. The flat bottom surfaces then can be connected to the circuit traces by a reflow soldering process. As seen in FIG. 10, the rear of housing 14 is open to allow visual inspection of the solder joints at least between the bottom terminals and the circuit traces on the printed circuit board.

It can be seen best in FIGS. 7–10 that the flat bottom surfaces 18*f* and 20*f* of the top and bottom terminals, respectively, are staggered in a front-to-rear direction to prevent solder bridging. As seen in FIGS. 8 and 10, tail portions 18*a* and 20*a* of the top and bottom terminals, respectively, are disposed and protected between the side walls of slots 30 and 32, respectively, into which the terminals are inserted. Only the bottom, board-mounting sections of the tail portions are exposed beyond bottom face 26 of the housing. This makes the connector more robust. Because the terminals are stamped and formed of sheet metal material, the shape of the terminals can be changed so that capacitive coupling is controlled. Because contact portions 18*d* and 20*d* of the terminals are bent generally at right-angles to arm portions 18*c* and 20*c*, respectively, of the terminals, there is no cut edge of the sheet metal material facing the terminals of the mating connector, and the flat contact portions 18*d* and 20*d* provide a smooth engaging surface less susceptible to damaging the mating terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a circuit board, comprising:

a dielectric housing having a top face, a bottom board-mounting face and a front mating portion extending generally parallel to the circuit board;

a set of first terminals mounted in the housing and insertable through the top face thereof and having tail portions for connection to appropriate circuit traces on the circuit board, the first terminals having contact portions on a top side of the mating portion of the housing for engaging appropriate contacts of a complementary mating connecting device; and a set of second terminals mounted in the housing and insertable through the bottom board-mounting face thereof and having tail portions for connection to appropriate circuit traces on the circuit board, the second terminals having contact portions on a bottom side of the mating portion of the housing for engaging appropriate contacts on the mating connecting device.

2. The electrical connector of claim 1 wherein the top and bottom sides of said mating portion of the housing have positioning channels for receiving the respective contact portions of the terminals.

3. The electrical connector of claim 2 wherein said contact portions are generally flat and generally coplanar at the top and bottom sides of the mating portion of the housing.

4. The electrical connector of claim 3 wherein said mating portion of the housing is flat with generally planar top and bottom sides generally parallel to the circuit board.

5. The electrical connector of claim 1 wherein the tail portions of the first and second terminals have coplanar surfaces for soldering to circuit traces on a mounting surface of the circuit board.

6. The electrical connector of claim 1 wherein the contact portions of the terminals have bent distal ends positioned in recesses in the mating portion of the housing to prevent the distal ends of the terminals from stubbing on the contacts of the mating connecting device.

7. The electrical connector of claim 1 wherein said first terminals have upwardly projecting pusher tabs to facilitate inserting the first terminals into the housing from the top face thereof until the tail portions of the first terminals are exposed at the bottom board-mounting face of the housing.

8. The electrical connector of claim 1 wherein said housing has an open rear end which allows for visual inspection of the connections between at least some of the terminals and the circuit traces on the circuit board.

9. An electrical connector for mounting on a circuit board, comprising:

a dielectric housing having a top face, a bottom board-mounting face and a front mating portion extending generally parallel to the circuit board, said mating portion being flat with generally planar top and bottom sides generally parallel to the circuit board, and the top and bottom sides of the mating portion having positioning channels extending in a mating direction;

a set of first terminals mounted in the housing and insertable through the top face thereof and having tail portions for connection to appropriate circuit traces on the circuit board, the first terminals having generally flat contact portions positioned in the positioning channels in the top side of the mating portion of the housing, the flat contact portions being generally coplanar at the top side of the mating portion for engaging appropriate contacts of a complementary mating connecting device;

a set of second terminals mounted in the housing and insertable through the bottom board-mounting face thereof and having tail portions for connection to appropriate circuit traces on the circuit board, the second terminals having generally flat contact portions positioned in the positioning channels in the bottom side of the mating portion of the housing, the flat contact portions being generally coplanar at the bottom side of the mating portion for engaging appropriate contacts of a complementary mating connecting device; and the tail portions of the first and second terminals having coplanar surfaces for soldering to circuit traces on a mounting surface of the circuit board.

10. The electrical connector of claim 9 wherein the contact portions of the terminals have bent distal ends positioned in recesses in the mating portion of the housing to prevent the distal ends of the terminals from stubbing on the contacts of the mating connecting device.

11. The electrical connector of claim 9 wherein said first terminals have upwardly projecting pusher tabs to facilitate inserting the first terminals into the housing from the top face thereof until the tail portions of the first terminals are exposed at the bottom board-mounting face of the housing.

12. The electrical connector of claim 9 wherein said housing has an open rear end which allows for visual inspection of the connections between at least some of the terminals and the circuit traces on the circuit board.

* * * * *